United States Patent [19]

Chiang et al.

[11] Patent Number: 4,797,085

[45] **Date of Patent: * Jan. 10, 1989**

[54] FORMING APPARATUS EMPLOYING A SHAPE MEMORY ALLOY DIE

[75] Inventors: Tien-Hon Chiang, El Toro; Donald N. Thatcher, Santa Ana, both of Calif.

[73] Assignee: Aerojet-General Corporation, La Jolla, Calif.

[ * ] Notice: The portion of the term of this patent subsequent to Apr. 19, 2005 has been disclaimed.

[21] Appl. No.: 33,664

[22] Filed: Apr. 3, 1987

Related U.S. Application Data

[63] Continuation-in-part of Ser. No. 938,204, Dec. 4, 1986, Pat. No. 4,738,610.

[51] Int. Cl.[4] ..... B30B 12/00

[52] U.S. Cl. ..... 425/405.2; 148/402; 264/56; 419/68; 425/78

[58] Field of Search ..... 148/402; 428/960; 419/49, 68; 425/77, 78, 405 R, 405 H, 407, 405.1, 405.2; 264/56

[56] References Cited

U.S. PATENT DOCUMENTS

| | | | |
|---|---|---|---|
| 3,189,942 | 6/1965 | Rapprich et al. | 425/78 |
| 3,470,289 | 9/1969 | Katsuki et al. | 264/313 |
| 4,373,012 | 2/1983 | Aslund et al. | 425/78 |
| 4,601,878 | 7/1986 | Aslund et al. | 425/78 |
| 4,675,061 | 6/1987 | Mead | 264/313 |

OTHER PUBLICATIONS

"55-Nitinol-The Alloy with a Memory", A Report, NASA-SP5110, Jackson, C. M. et al., 1972 pp. 77-79.

*Primary Examiner*—Jan H. Silbaugh
*Assistant Examiner*—Jill L. Fortenberry
*Attorney, Agent, or Firm*—Leonard Tachner

[57] ABSTRACT

An apparatus using a shape memory alloy such as nickel-titanium as a die material in one embodiment is used for performing pseudo-isostatic pressing by using a uniaxial mechanical press to densify a powder mixture, preform or presinter with or without the use of pressure transmitting powder. The apparatus can also be used to perform thermal mechanical work on any article to obtain near net shape. With controlled thermal mechanical processing and fabrication of the shape memory alloy into a die configuration, its shape can be changed from a low temperature configuration to a high temperature configuration after being treated. As a result, near net shape parts can be cold or hot pressed pseudo-isostatically without using an expensive and sophisticated press apparatus of the prior art. In a second embodiment, the shape memory alloy is employed as the expansion tooling for near net shape forming of composite materials. This embodiment utilizes a thin wall and a thick wall tube which are made of a shape memory alloy to perform near net shape compression molding of fiber reinforced composites into closed form structure.

15 Claims, 4 Drawing Sheets

FORMING APPARATUS EMPLOYING A SHAPE MEMORY ALLOY DIE

CROSS-REFERENCE TO RELATED APPLICATIONS

This application is a continuation in-part of application Ser. No. 938,204, now U.S. Pat. No. 4,738,610 filed Dec. 4, 1986.

BACKGROUND OF THE INVENTION

1. Field of the Invention

The present invention relates generally to the field of mechanical processing of materials such as shape forming of composite materials and more specifically, to an apparatus and method for forming parts by exploiting the anthropomorphic qualities of shape memory alloys.

2. Prior Art

The material that has come to be called shape memory alloys has been known for some time. By way of example, in an article entitled "Shape Memory Alloys" written by L. MacDonald Schetky and appearing in the Scientific American, November 1979 issue beginning at page 74, the author thoroughly explains the mechanical properties of these alloys and indicates that they first came to worldwide attention in 1962. As the author in that article explains, the phenomenon of shape memory alloys is dependent upon the characteristic of certain materials to possess a martensite crystal structure deriving from a parent crystal phase when treated by a certain combination of stress and temperature processing. This martensitic crystal phase can then be transformed back into its parent crystal phase thermoelastically by elevating the temperature of the material. In addition, for the "two-way" shape memory alloys, the phase transformation can be reversed by then lowering the temperature of the material. As a result of these phase transformations the material can be induced to change its shape in a carefully controlled and reversible manner by simply controlling the temperature of the material to induce the aforementioned phase transformations. The article by Schetky illustrates a particular exploitation of this phenomenon for automatically deploying an antenna for a spacecraft. An updated description of the "Shape Memory Effect Alloys" can also be found in the "Encyclopedia of Materials Science and Engineering", volume 6, pages 4365–4374, M.I.T. Press, 1986. However, it is believed that the use of this phenomenon in a press or die for applying reasonably high mechanical pressure forces for pseudo-isostatically pressing one or more parts is a unique application of this phenomenon which has heretofore not been disclosed in the art. The most relevant prior art known to the applicants in this regard will now be disclosed.

U.S. Pat. No. 3,558,369 to Wang et al is directed to a method of effecting a reversion back to an original configuration by means of a martensitic transition of a metal alloy. The alloy is subjected when in an original configuration to deformation at a temperature below a critical temperature to change the shape and then heat the alloy above the critical temperature to effect a reversion.

U.S. Pat. No. 3,579,805 to Kast is directed to a method of forming interference fits by heat treatment. In this patent, members are provided which are formed of a precipitation hardenable alloy composition which undergoes irreversible dimensional changes upon heat treatment. The precipitation hardenable alloy is solution annealed at a temperature higher than the solutioning temperature of the alloy. The members are interfit to form an assembly with a clearance between the members which is less than the irreversible dimensional change and the assembly is subjected to a precipitation hardening heat treatment which causes the irreversible dimensional change.

U.S. Pat. No. 3,832,763 to Schober is directed to a method of drop-forging sintered workpieces. This disclosure provides essentially for a deviation of the shape of the drop forging die wherein a solid cylindrical prestressed body is placed into the cavity of a forging die. The cavity of the forging die has a lateral dimension normal to the forging direction wherein this lateral dimension is larger than the diameter of the body. There is no reference to a shape memory alloy die.

U.S. Pat. No. 4,019,925 to Nenno et al is directed to metal articles having a property of repeatedly reversible shape memory effect and the process for preparing such which includes deformation stress to a martensitic alloy.

U.S. Pat. No. 4,036,669 to Brook et al is directed to a mechanical pre-conditioning method and to a mechanical composition capable of undergoing a reversible transformation between the austenitic and martensitic states. The article is deformed from an original configuration into a second predetermined shape from which heat recovery towards the original configuration is desired. Constraining forces are applied to the article and the article is held in the deformed configuration at a predetermined high temperature at which the formation of the martensite in the metallic composition is induced thermally in the absence of applied stress for a predetermined time. This causes a portion of the deformation to be retained as heat recoverable strain.

U.S. Pat. No. 4,149,911 to Clabburn is directed to a memory metal article and a method of making the heat recoverable memory metal member. A stress is applied to the member in a deformed dimensionally heat-unstable state and such temporarily increases the temperature at which formation of austenite begins. This is accomplished while maintaining an applied stress. The article is stored at a temperature less than the higher temperature and the memory metal member then remains in a martensitic state.

U.S. Pat. No. 4,198,081 to Harrison et al is directed to a heat recoverable metallic coupling. A coupling is installed on pipes to be connected and the joint is heated to greater than the transition temperature of the material of the coupling. The coupling is heat recoverable and recovers or shrinks to the heat-stable configuration until it engages the objects and is restrained from further recovery. This creates a tight fit on the object as long as the joint is maintained above the transition temperature. The restraining action of the objects on the coupling introduces non-thermally recoverable plastic deformation stresses into the material of the coupling and when the coupling is cooled to the transition temperature, the stresses are released in spontaneous expansion and the coupling may be removed from the objects.

U.S. Pat. No. 4,283,233 to Goldstein et al is directed to a method of modifying the transition temperature range of a nickel-titanium based shape memory alloys. This is done by the selection of the final annealing temperature. The alloy however is formed into a predetermined permanent shape.

U.S. Pat. No. 4,533,411 to Melton is directed to a method of processing nickel/titanium base shape-memory alloys and structures. The reference teaches cold working an alloy formed of a nickel-titanium based shape memory alloy and provides the alloy in some desired shape while maintaining dislocation-free cells which are obtained in the annealing step. The alloy is deformed in the martensitic state whereby when the alloy is recovered by heating the alloy to the austenitic state and then again cooled to the martensitic state, the alloy will retain the predetermined contour.

Other prior art patents which may be deemed to be relevant to the present invention comprising the following: U.S. Pat. Nos. 3,285,470 Frei et al, 3,622,941 Wetmore, 3,652,969 Willson et al, 3,783,037 Brook et al, 4,035,007 Harrison et al, 4,045,644 Shafer et al, 4,067,752 Brook et al, 4,113,475 Smith, 4,310,354 Fountain et al, 4,365,996 Melton et al, 4,412,872 Albrecht et al, 4,483,174 Goodfellow, 4,489,964 Kipp et al, 4,518,444 Albrecht et al, 4,554,027 Tautzenberger et al.

SUMMARY OF THE INVENTION

A first embodiment of the present invention relates to an apparatus and process using a shape memory alloy such as nickel-titanium as a die material for performing pseudoisostatic pressing by using a uniaxial mechanical press to densify a powder mixture, preform or presinter with or without the use of pressure transmitting powder. The process can also be used to perform thermal mechanical work on any article to obtain near net shape. With controlled thermal mechanical processing and fabrication of the shape memory alloy into a die configuration, its shape can be changed from a low temperature configuration to a high temperature configuration after being heated. The shape transformation temperature for nickel-titanium alloy in particular, ranges from about −200 degrees Centigrade to +100 degrees Centigrade depending primarily upon alloy composition. For a hollowed cylindrical die made from nickel-titanium alloy which possesses shape memory effect, the inner diameter of the die can change as much as 8% and exert tens of thousands of pounds per square inch pressure in the radial direction. As a result, near net shape parts can be cold or hot pressed pseudo-isostatically without using an expensive and sophisticated press apparatus of the prior art.

A simple uniaxial vertical press may be used as a component of the present invention. In the simplest form the process and apparatus of the first embodiment of the present invention are used to densify a powder mixture such as a metal, ceramic or combination of the two by controlling the temperature of the shape memory alloy material of which the die is configured to create a phase transformation from martensitic to its parent phase to decrease the volume of the chamber within the die in which the part to be pressed is positioned.

Although in the embodiment of the invention described herein, the shape memory alloy die is provided in a cylindrical configuration and a uniaxial vertical press is utilized to complement the pressing apparatus and process, the invention is not deemed to be limited to any particular die configuration. In fact, it would be entirely plausible to provide the die in the shape of a sphere or other fully enclosed volumetric shape to accomplish the objectives of the invention. A pressure transmitting powder, commonly known in the materials processing art, may be used to fill the chamber when the parts to be pressed do not otherwise utilize the full volumetric capacity of the chamber, in order to apply substantially isostatic forces to the parts to be pressed. Temperature control of the shape memory alloy material may be accomplished in a variety of ways, however, one embodiment of such temperature control disclosed herein comprises the use of a coil-shaped tube comprising a thermally conductive material such as copper for carrying a cooling or heating fluid, the coil being in contiguous engagement with the outer periphery of the die.

A second embodiment of the present invention relates to an apparatus and process using a shape memory alloy as the expansion tooling for near net shape forming of composite materials. Near net shape forming of continuous fiber reinforced composite materials (both resin and metal matrix) to obtain a closed form structure such as a long tube with complex grooves on the outer surface, cannot be easily achieved by means of conventional process such as compression molding or squeeze casting. In the present invention a thin wall tube and a thick wall tube are both made of a shape memory alloy and are positioned in contiguous relation to a near net shape product contained within the cavity of an outer split die. The thin wall tube is designed to seal the die cavity upon radially outward expansion. The thick wall tube is inserted within the expanded thin wall tube after the preform has been heated to slightly above its melting point or in the solid-liquid two-phase regime of the metallic matrix phase. The thick wall tube shape memory alloy is heated to its transformation phase by the heat of the die and the preform, causing it to expand and apply enormous radial forces to compact the preform into a near net shape composite product. The present invention may be summarized as being an apparatus and process which provide tooling comprising shape memory alloys having anthropomorphic qualities which significantly reduce the otherwise costly and complex requirements of conventional material forming devices.

OBJECTS OF THE INVENTION

It is therefore a principal object of the present invention to provide an apparatus and process for mechanically treating materials and specifically for forming materials by taking advantage of the controlled anthropomorphic qualities of shape memory alloys.

It is an additional object of the present invention to provide a near net shape forming apparatus at least a portion of which comprises a shape memory alloy defining expansion tooling which exerts a selected force upon a preform in response to temperature variation of the alloy material.

It is still an additional object of the present invention to provide an apparatus for near net shape forming of composite materials and apparatus comprising a tubular structure at least a portion of which is formed of a shape memory alloy capable of reversible dimensional modification when selectively transformed from a martensitic phase to its parent phase by temperature elevation.

It is still a further object of the present invention to provide a method of forming near net shape composite parts, the method comprising the steps of placing a preform in a cavity of a split die, inserting into the cavity a tube which is formed of a shape memory alloy capable of a reversible dimensional modification when selectively transformed from a martensitic phase to its parent phase by temperature elevation, and then raising the temperature of the alloy for a predetermined period of time to expand the tube and radially compress the preform into a near net shape form.

BRIEF DESCRIPTION OF THE DRAWINGS

The aforementioned objects and advantages of the present invention as well as additional objects and advantages thereof will be more fully understood hereinafter as a result of a detailed description of preferred embodiments of the invention when taken in conjunction with the following drawings in which.

DETAILED DESCRIPTION OF PREFERRED EMBODIMENTS

THE PRESS EMBODIMENT

Figure 1:
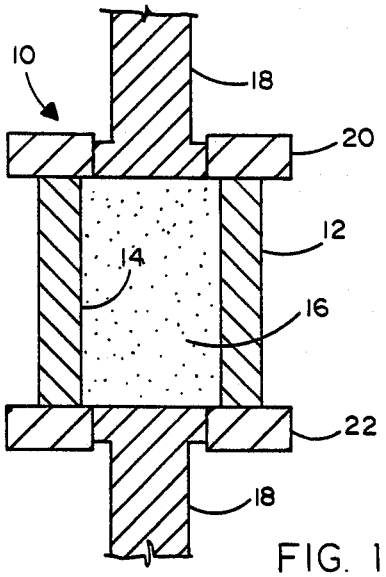
FIGS. 1 and 2 illustrate the inactive and activated configurations, respectively, of a first configuration of the press embodiment of the present invention.
Figure 2:
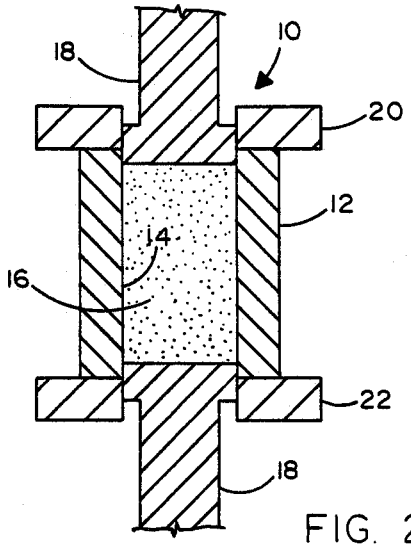

One configuration of a press embodiment of the invention is illustrated in FIGS. 1 and 2. As shown in those figures, a pseudo-isostatic press 10 comprises a shape memory alloy die 12 in the form of a circular cylinder hollowed to form an interior chamber 14 into which either a pressure transmitting powder or powder mixture 16 to be pressed is inserted. In the particular configuration illustrated in FIGS. 1 and 2 a pair of mechanical rams 18 is provided to seal the axial ends of the shape memory alloy die 12 and provide a means for exerting an axially directed force concurrently with the radially directed force induced by the die 12. An end cap 20 is provided at the top of cylinder 12 and a base 22 is provided at the bottom of cylinder 12. The end cap 20 and base 22 are each of annular configuration each having an inner diameter which is approximately equal to the inner diameter of the shape memory die 12 when the latter is in its high temperature parent phase state which is also equal to the diameter of the ram portion of mechanical rams 18. In this fashion the chamber 14 is always sealed by the combination of the die 12, the mechanical rams 18, the end cap 20 and the base 22 and the rams, the press, the end cap and the base are configured so that during the pressurization cycle the mechanical ram 18 is not jammed by the die 12.

The shape memory alloy comprising the die 12 may be any one of a plurality of alloys which exhibit the shape memory characteristic. The following alloys have exhibited such a characteristic: gold-cadmium, nickel-titanium, indium-thallium, indium-cadmium, iron-nickel, nickel-aluminum, copper-zinc, copper-aluminum, iron-platinum, silver-zinc, silver-cadmium, uranium-niobium, nickel-copper-titanium and copper-aluminum-zinc. Because of material characteristics and cost considerations of the previously mentioned group of shape memory effect alloys, the most likely candidates for use in the present invention are nickel-titanium, iron-nickel, nickel-copper-titanium and copper-aluminum-zinc.

To start a pressurization cycle for pressing either the powder 16 or an article contained within the chamber and surrounded by pressure transmitting powder, the shape memory alloy die is heated by using an external heating device, assuming the transformation temperature is above room temperature, to reach transformation temperature and trigger the martensitic to its parent phase transformation. When the die reaches transformation temperature it will change rapidly from its low temperature, martensitic to its high temperature, parent phase configuration as shown in the transition between FIGS. 1 and 2. As a result, the die exerts a preselected level of lateral pressure on the powder 16. In the meantime, the mechanical rams 18 maintain a proper level of pressure on the die cavity such that the effect of isostatic pressing is optimized. After the pressing cycle is completed the die assembly is cooled to a lower temperature so that the densified mixture 16 can be easily removed from the die cavity. The shape memory effect of the die is reversible with proper alloy selection and thermal mechanical processing. As a result, the high temperature configuration of the die may be returned to its low temperature configuration after being cooled and/or reprocessed and may be reused for subsequent pressing.

Figure 3:
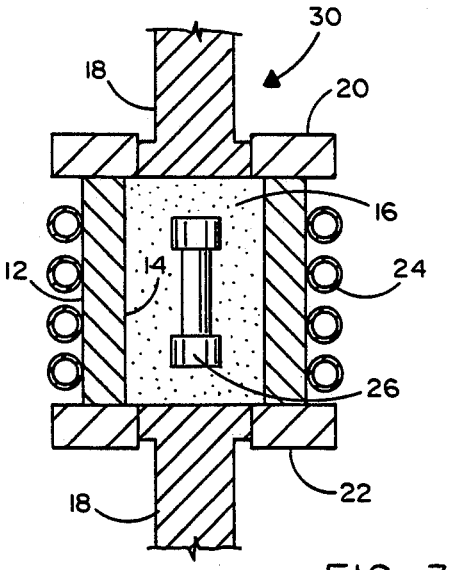
FIGS. 3 and 4 indicate the inactive and activated configurations, respectively, of another configuration of the press embodiment of the present invention.
Figure 4:
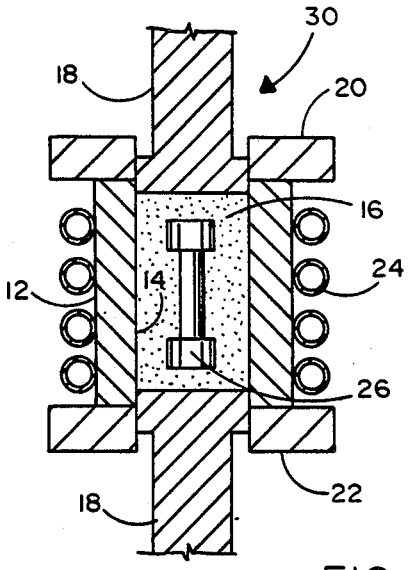

The process of the present invention can also be applied to hot or cold pressing any powder mixture preform, presinter or solid part into a more complicated shape with some minor modification of the basic process described above. The steps for pressing complicated shape articles is depicted in FIGS. 3 and 4 which illustrate an alternative embodiment of the present invention. As shown in FIGS. 3 and 4 the part or preform 26 to be pressed is placed into the chamber 14 of the shape memory die 12 of the second embodiment 30. If the part 26 does not fill up the die cavity or chamber 14, pressure transmitting powder 16 may be used to pack the die chamber. The particle size, shape and physiochemical nature of the pressure transmitting powder are carefully selected so that friction loss during pressurization is minimized. If the part 26 is to be hot pressed, the part is preheated to the desired temperature before the pressure transmitting powder 16 is added to the chamber. Alternatively, the pressure transmitting powder 16 may be heated which in turn heats the part 26. High temperature chemical stability of the pressure transmitting powder 16 is an important consideration for avoiding undesirable reaction among the part 26, the powder 16 and the die 12.

The temperature of the shape memory alloy die 12 may be controlled in a number of ways, however, in the particular configuration illustrated in FIGS. 3 and 4 temperature control is provided by a tube 24 which is helically wound around the outer periphery of the die and is in contiguous engagement therewith. Coil 24 is preferably made of a thermally conductive material such as copper. The temperature of the coil may be controlled by the use of selected fluids for flowing therethrough depending upon the temperature requirements during the pressing process. Thus for example, during the packing of the part within the chamber 14, with or without pressure transmitting powder 16, the die may be retained in its low temperature configuration by circulating cooling water or other flowable coolant through the copper tube 24. The chamber 14 is packed so that the surface of the part 26 is subjected to an adequate level of compression during the pressurization cycle. This is particularly important when the pressure transmitting powder 16 is used. It may be desirable to use the mechanical press or rams 18, which may be of either a single or double action type, to prepress the filled die chamber before the shape memory alloy die is activated. As in the first configuration of the press of the invention illustrated in FIGS. 1 and 2, the die assembly is covered by an end cap 20 and is supported by a base 22. Here again, the mechanical rams 18, the end cap 20 and the base 22 are configured so that during the pressurization cycle the rams are not jammed by the die.

To begin a pressurization cycle for cold pressing, the shape memory alloy die is heated by using an external heating device to reach transformation temperature and trigger the martensitic to its parent phase transformation. For hot pressing a temperature control mechanism can be adapted so that the heated part 26 and/or the heated pressure transmitting powder 16 can heat up the die when needed to trigger the transformation. Alternatively, the coil 24 may be used to apply the phase transformation temperature to the die by substituting a hot flowable material for the cooling water previously mentioned.

When the die 12 reaches the transformation temperature its configuration changes rapidly from the low temperature to the high temperature state. The result is a reduction in the diameter of the chamber 14 as shown in FIG. 4 and the exertion of a desirable level of lateral pressure on the pressure transmitting powder 16 and/or the part 26. Concurrently, the mechanical rams 18 maintain a proper level of pressure on the die cavity so that the effect of isostatic pressing is optimized. After the pressing cycle is completed the die assembly is cooled to a lower temperature so that the densified part 26 can be easily removed from the die cavity. The shape memory effect of the die is reversible with proper alloy selection and thermal mechanical processing. As a result, the high temperature configuration may return to its low temperature state after being cooled and/or reprocessed and may be reused for subsequent pressing.

It will be understood that neither the particular configurations illustrated in FIGS. 1–4 nor the particular shape of the shape memory alloy die illustrated therein are to be deemed limiting of the present invention. Thus for example, other shapes for the shaped memory die of the present invention may be utilized as long as an enclosed chamber can be implemented. Spherically configured shape memory alloy presses, for example, may also be suitable for use in the present invention while obviating the requirement for a supplementary mechanical press for axially loading the contents of the chamber as discussed above. Alternatively, the cylindrical die configuration of FIGS. 1–4 may be other than circular in cross-section. Oval shapes or rectangular shapes may also be useable for carrying out the process of pressing utilizing the shape memory characteristic of the die material. If a mechanical ram is desired or necessary as a result of the shape of the die, it is possible to carry out the process of the present invention using only one such mechanical ram on one axial end of the die and a fixed base on the other end.

Figure 5:
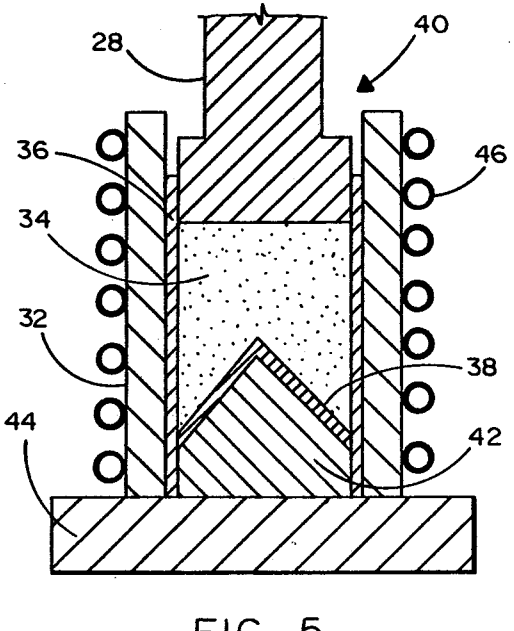

The process of the press embodiment of the present invention finds particularly advantageous use in the fabrication of penetrator-type projectiles. By way of example, FIG. 5 illustrates the use of an alternative configuration of the invention for pressing the explosive on a shaped charge liners using shape memory alloy dies for better density distribution. In particular, in the alternative embodiment 40 illustrated in FIG. 5, the die assembly comprises a shape memory alloy cylinder 32 forming a chamber for containing a PBX explosive powder 34 within a case 36. The chamber also receives a shaped charge liner 38 which is formed on a mandrel 42 contained within the chamber. The bottom end of the chamber is enclosed by a base 44 of fixed configuration and the top end is secured by a mechanical plunger 28. A temperature control coil 46 provides the temperature variation required to activate the shape memory alloy in the manner previously described.

Figure 6:
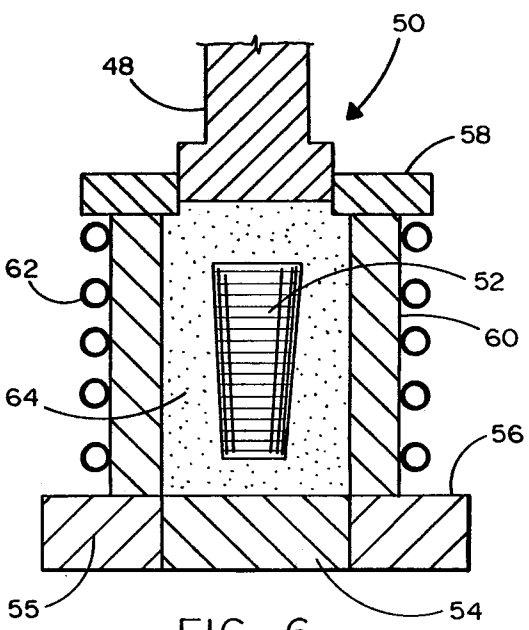
FIGS. 5 and 6 illustrate two additional configurations of the press embodiment of the present invention for use on specific shapes of articles to be pressed in accordance with the process of the present invention.

In another alternative configuration shown in FIG. 6, a pseudo-isostatic press 50 is used to fabricate a graded penetrator 52. The embodiment 50 comprises a shape memory alloy hollowed cylinder 60 surrounded by a temperature control coil 62 and forming a chamber filled with a pressure transmitting powder 64. A mechanical plunger 48 is used to secure the top-most axial end of the die assembly in conjunction with an end cap 58 while a double action ram 54 and base 55 provide means for enclosing the lower end of the chamber within the hollowed cylinder 60.

THE EXPANSION EMBODIMENT

The expansion embodiment 70 of the present invention and the near net shape forming process of the embodiment, are illustrated in FIGS. 7–10. The expansion embodiment illustrated therein employs an outer split die 72 having an interior cavity 74. The cavity 74 is suitably shaped to receive the metal matrix composite or resin matrix composite preform 76 as well as two tubes 80 and 84. The tubular portion of cavity 74 may be provided with a pair of annular recesses 75 into which the annular beads 82 of thin wall tube 80 fit respectively for improved sealing. Thin wall tube 80 is used as a pressure seal and is of dimensions suitable for receiving thick wall tube 84 after initial expansion. Thick wall tube 84 provides an inner die to match outer split die 72. Thick wall tube 84 is provided with a cooling coil 86 and outer die 72 is provided with a heater 78.

The expansion process of the embodiment of FIGS. 7–10 relies on the phase transformation of the thick wall tube 84, which is a shape memory alloy such as Ni-Ti or its derivative, to preform near net shape compression molding of fiber reinforced metal or resin matrix composite materials or the like. The thin wall tube 80 may also be a shape memory alloy material. As a result, both tubes 80 and 84 can be configured so that their respective outer diameters increase when heated to the martensitic-austenitic transformation temperature and thereby exert up to tens of thousands of pounds per square inch pressure in a radial direction.

Figure 7:
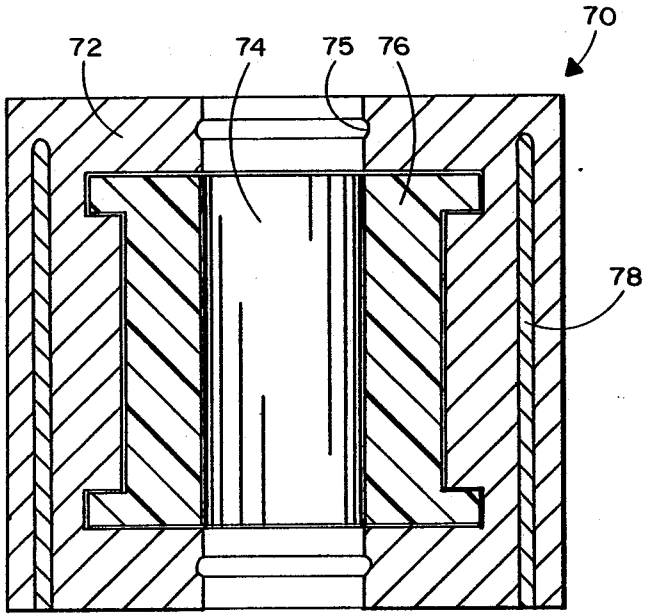
FIG. 7 is a cross-sectional view of the split die of the expansion embodiment of the present invention.

The steps of the expansion forming press using SiC continuous fiber reinforced aluminum as a preform example, may be described as follows:

(1) Commercially available metal matrix composite preforms 76, such as plasma sprayed aluminum on silicon carbide fiber "green tape" are placed in the cavity 74 of outer split die 72 as shown in FIG. 7. Die 72 may be made of high temperature resistant alloys such as M11 steel.

Figure 8:
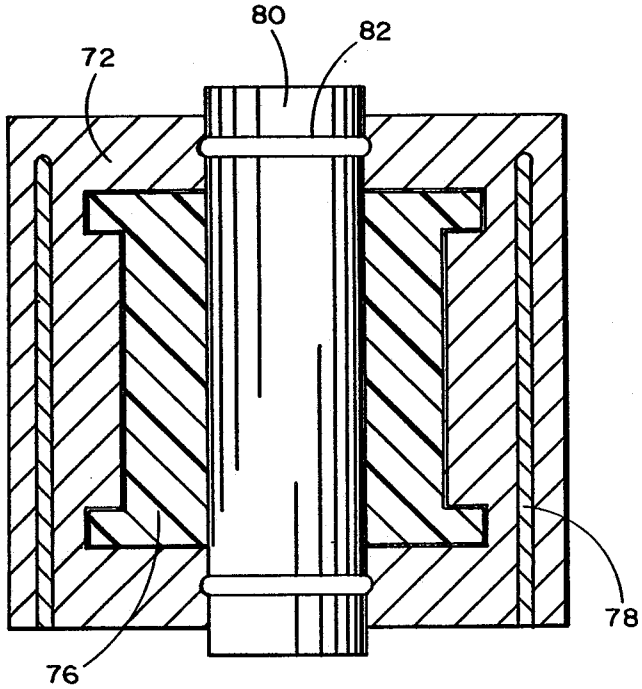
FIG. 8 is a view similar to that of FIG. 7 but showing the invention after the thin wall tube has been positioned in the split die.

(2) Thin wall tube 80 is then inserted into the central region of cavity 74 inside the preform 76 as shown in FIG. 8. The wall thickness of thin wall tube 80 is designed to exert an adequate level of pressure to seal the die cavity 74 when the tube expands after being heated. The annular beads 82 are also made of shape memory alloy to aid the sealing effect. Stop off material such as Yttria, may be sprayed on both the inner and outer surfaces of thin wall tube 80. If the cost of using shape memory alloy thin wall tube 80 is higher than desired, other high temperature thin wall materials and structures can be used to seal the preform cavity using more conventional mechanical means.

(3) Die cavity 74 is then heated by heater 78 to slightly greater than the melting point or in the solid-liquid two-phase regime of the metal matrix phase. Because the thin wall tube 80 is intended to be a disposable sealing device, high temperature creep and loss of shape memory characteristic do not impede its intended usage.

Figure 9:
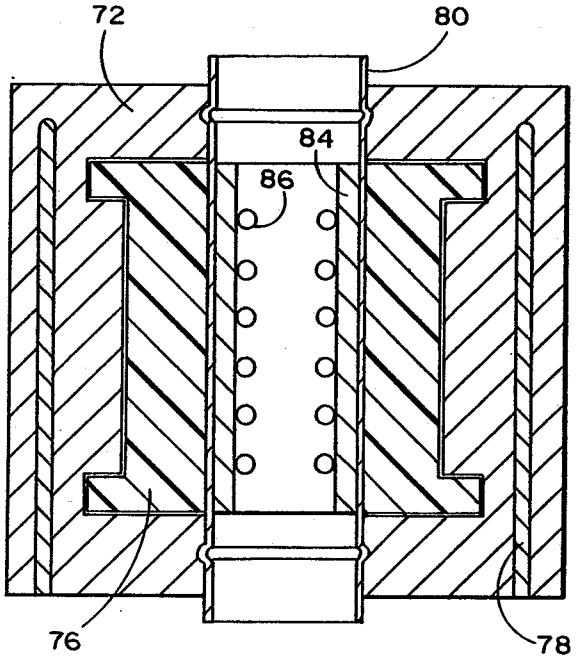
FIG. 9 is a view similar to that of FIG. 8 but showing the invention after the thick wall tube has been positioned within the thin wall tube.

(4) After the metal matrix composite preform 76 reaches the desired temperature and is stabilized, thick wall tube 84, which serves as an expandable, matching die to form the part, is inserted through the thin wall tube 80 as shown in FIG. 9.

Figure 10:
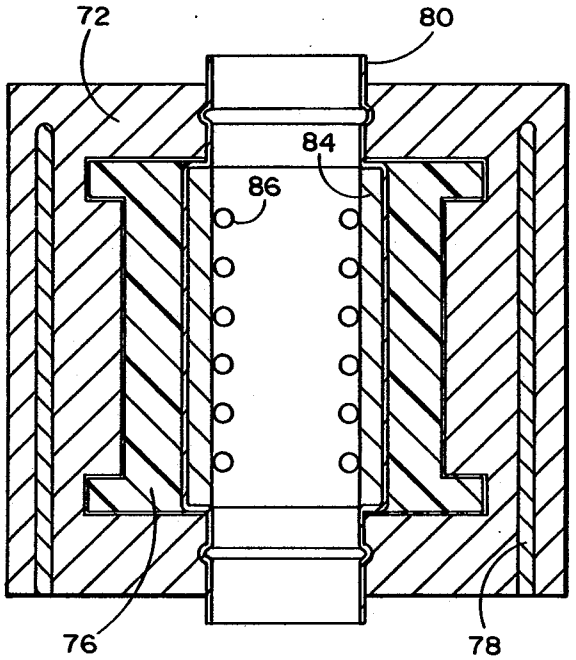
FIG. 10 is a view similar to that of FIG. 9 but showing the invention after the heated thick wall tube memory shape alloy has expanded.

(5) The temperature increase of the thick wall tube 84 is controlled by monitoring the process parameters of heater 78 and cooling coil 86 so that expansion and radial pressure exerted on preform 76, follow a sigmoidal curve typical of the recovery force versus temperature of Ni-Ti shape memory alloys. Solidification of the molten or semi-molten metallic matrix phase of the preform 76 should begin at the inner radial surface of the preform and travel toward the outer radial surface. The radial pressure exerted by the cooler, expanding thick wall tube 84 should eliminate most of the possible casting defect in a manner similar to the squeeze casting process commercially practiced for fabricating metal matrix composites. The apparatus configuration at the end of the solidification process is illustrated in FIG. 10. If necessary, the outer heated die 72 may be provided with a riser area to hold excess molten metallic matrix phase.

(6) After the metallic phase completely solidifies in the desired near net shape composite product and is cooled, the outer die 72 may be separated. Furthermore, thick wall tube 84 can be returned to its low temperature configuration by further cooling and then separated from the completed part. Because the shape memory effect is reversible, tube 84 can be reused.

It will now be understood that what has been disclosed herein in one embodiment comprises a unique new pseudo-isostatic press and process for pressing employing a shape memory alloy in the form of a die, the die being configured to provide a chamber for receiving one or more parts to be pressed pseudo-isostatically. The chamber may also be adapted to receive a pressure transmitting powder for parts which do not otherwise fill the chamber. The die may be operated in conjunction with one or more vertical presses, rams or plungers if needed to seal the chamber and maintain the pressure during activation of the die. An end cap may be used to configure the interface between the die and the vertical press during the pressurization cycle so that the die does not jam the vertically moving member. Temperature control means such as a helically wound copper coil carrying a suitably cooled or heated fluid, may be used to control the temperature of the shape memory alloy to trigger a transformation between a martensitic phase and its parent phase in the alloy thereby reducing the inner diameter of the chamber and thus providing a substantial increase in pressure applied to the part. The method of the present invention, namely, the method of pseudo-isostatically pressing parts, comprises the steps of placing the parts in a hollow enclosed structure at least a portion of which is formed of a shape memory alloy capable of a reversible dimensional modification when selectively transformed from a martensitic phase to its parent phase by temperature elevation, surrounding the parts with a pressure transmitting medium and then raising the temperature of the alloy for a predetermined period of time. As a result of the present invention the complex and costly structure of prior art isostatic presses may be significantly reduced.

It will also now be understood that in a second embodiment disclosed herein the invention comprises a novel new apparatus and process for near net shape forming of metal or resin matrix composite materials by using shape memory alloy tooling as an expansion die. The apparatus utilizes an outer heat resistant die that provides a cavity for receiving the composite materials and an inner die made of shape memory alloy. The inner die is in the form of a tube the wall of which expands when the apparatus is heated to the phase transformation temperature of the alloy. An additional tube of shape memory alloy, but having a relatively thin wall configuration, may be used to preliminarily seal the composite material in the cavity of the outer die before the inner die is positioned within the apparatus. The outer die is preferably of split configuration to facilitate the process and to permit recovery and reuse of the inner die.

Those having skill in the art to which the present invention pertains will now as a result of the teaching herein perceive various modifications and additions to the invention. By way of example, other shape memory alloy materials which also exhibit the anthropomorphic qualities of the specific materials recited herein may be substituted for those disclosed in the application. Furthermore, other geometric shapes of the alloy forming die for the purpose intended herein, will now occur as well as various alternative modifications which use different geometric configurations and different combinations of shape memory alloy dies and other mechanical pressure-inducing devices for subjecting the parts to the requisite pressure levels. However, it will be understood that all such modifications and additions are deemed to be within the scope of the invention which is to be limited only by the claims appended hereto.

We claim:

1. An expansion forming apparatus comprising:

an outer die of generally cylindrical shape and having an interior cavity for receiving material to be formed, and an inner die also of generally cylindrical configuration and positioned within said cavity in substantially contiguous engagement with said material, the inner die being made of a shape memory alloy for compression of said material between said inner die and said outer die in response to heat applied to said apparatus for selectively causing transformation of said alloy between a martensitic phase and its parent phase for selectively increasing the outer radial dimension of said inner die.

2. The forming apparatus recited in claim 1 further comprising means for sealing said material in said cavity.

3. The forming apparatus recited in claim 2 wherein said sealing means comprises a tubular member positioned between said inner die and said material.

4. The forming apparatus recited in claim 3 wherein said tubular member also comprises a shape memory alloy for sealing in response to selectively applied heat.

5. The forming apparatus recited in claim 1 wherein said shape memory alloy comprises at least one alloy from the group consisting of gold-cadmium, nickel-titanium, indium-thallium, indium-cadmium, iron-nickel, nickel-aluminum, cooper-zinc, copper-aluminum, iron-platinum, silver-zinc, silver-cadmium, uranium-niobium, nickel-copper-titanium and copper-aluminum-zinc.

6. The forming apparatus recited in claim 1 wherein said outer die is split to facilitate placement and removal of said inner die and said material.

7. The forming apparatus recited in claim 1 wherein said outer die also comprises a heater for applying heat to said material and to said inner die.

8. The forming apparatus recited in claim 3 wherein the wall thickness of said tubular member is less than the wall thickness of said inner die.

9. An apparatus for near net shape forming of composite materials, the apparatus comprising:

an outer die made of a high temperature resistant material;

an inner die made of a shape memory alloy;

said outer and inner dies being positioned in generally concentric relationship to form a cavity therebetween for receiving said composite materials; and means controlling the temperature of said inner die and said materials for selectively causing transformation of said alloy between a martensitic phase and its parent phase for selectively expanding the inner die for compressing said materials.

10. The forming apparatus recited in claim 9 further comprising means for sealing said material in said cavity.

11. The forming apparatus recited in claim 10 wherein said sealing means comprises a tubular member positioned between said inner die and said material.

12. The forming apparatus recited in claim 11 wherein said tubular member also comprises a shape memory alloy for sealing in response to selectively applied heat.

13. The forming apparatus recited in claim 9 wherein said shape memory alloy comprises at least one alloy from the group consisting of gold-cadmium, nickel-titanium, indium-thallium, indium-cadmium, iron-nickel, nickel-aluminum, copper-zinc, copper-aluminum, iron-platinum, silver-zinc, silver-cadmium, uranium-niobium, nickel-copper-titanium and copper-aluminum-zinc.

14. The forming apparatus recited in claim 9 wherein said outer die is split to facilitate placement and removal of said inner die and said material.

15. The forming apparatus recited in claim 11 wherein the wall thickness of said tubular member is less than the wall thickness of said inner die.

* * * * *